United States Patent [19]

Lauterwald

[11] Patent Number: 5,034,578

[45] Date of Patent: Jul. 23, 1991

[54] TAP-CHANGING BRIDGE CONTACT FOR TRANSFORMER

[75] Inventor: Rolf Lauterwald, Pettendorf, Fed. Rep. of Germany

[73] Assignee: Maschinenfabrik Reinhausen GmbH, Regensburg, Fed. Rep. of Germany

[21] Appl. No.: 574,263

[22] Filed: Aug. 28, 1990

[30] Foreign Application Priority Data

Aug. 28, 1989 [DE] Fed. Rep. of Germany ..... 3928359

[51] Int. Cl.[5] ..... H01H 19/58; H01H 1/50

[52] U.S. Cl. ..... 200/11 B; 200/11 TC; 200/260

[58] Field of Search ..... 200/11 B, 11 C, 11 TC, 200/15, 252-261, 251, 250, 11 G

[56] References Cited

U.S. PATENT DOCUMENTS

| | | | |
|---|---|---|---|
| 3,045,090 | 7/1962 | Wilson, Jr. et al. | 200/11 B X |
| 3,137,778 | 6/1964 | Barr | 200/259 |
| 3,192,328 | 6/1965 | Wilson, Jr. | 200/11 B |
| 3,678,237 | 7/1972 | Rickert et al. | 200/259 X |
| 4,931,599 | 6/1990 | Bleibtreu | 200/11 TC X |

FOREIGN PATENT DOCUMENTS

| | | | |
|---|---|---|---|
| 162527 | 12/1949 | Austria . | |
| 199759 | 9/1958 | Austria . | |
| 1102243 | 3/1961 | Fed. Rep. of Germany | 200/11 B |
| 1193145 | 5/1965 | Fed. Rep. of Germany . | |
| 2354173 | 5/1975 | Fed. Rep. of Germany . | |

*Primary Examiner*—J. R. Scott

*Attorney, Agent, or Firm*—Herbert Dubno; Andrew Wilford

[57] ABSTRACT

A bridge-contact assembly used in combination with an inner contact ring and a contact terminal of an array concentrically surrounding the ring comprises a contact housing rotatable concentrically with and between the ring and array, a pair of bridge-contact jaws extending between the ring and the array and having inner ends gripping the ring and outer ends gripping a one of the terminals of the array, and a contact holder spacedly surrounding the pair of jaws and spacedly surrounded by the contact housing. At least one jaw spring supports the jaws in the holder and urges the jaws together and at least one holder spring supports the holder in the contact housing.

9 Claims, 1 Drawing Sheet

TAP-CHANGING BRIDGE CONTACT FOR TRANSFORMER

FIELD OF THE INVENTION

The present invention relates to a switching arrangement for a tapped transformer. More particularly this invention concerns a tap-changing bridge contact for such a transformer.

BACKGROUND OF THE INVENTION

A tapped transformer typically has, as described in Austrian patent 162,527, a plurality of taps connected to respective contact terminals arranged in annular arrays spaced apart in an insulating sleeve along the axis of the sleeve. Level with each such array is a contact ring and a respective radially extending bridge contact has an inner end that grips this ring and an outer end that can grip any one of the contact terminals of the respective array. These bridge contacts, which are described in some detail in U.S. Pat. Nos. 4,931,599, 4,935,586, and 4,939,319 of A. Bleibtreu, are in turn carried by a switching rotor so that they can be moved jointly to connect the inner rings to the selected outer contact terminals.

As described in German patent documents 1,193,145 and 2,354,173 of R. Heinz such a bridge contact comprises a pair of relatively displaceable and substantially identical jaws that are urged together by at least one spring to grip the inner contact ring and the respective outer contact terminal. The overall radial length of such a bridge contact is a function of the voltage of the system, and also of the number of terminals in each annular array. Thus different bridge contacts must be used for different systems.

In addition such bridge contacts and the contact terminals must be made to fairly close tolerances. If not the bridge contacts become canted and jam.

OBJECTS OF THE INVENTION

It is therefore an object of the present invention to provide an improved bridge-contact assembly for a tapped transformer.

Another object is the provision of such an improved bridge contact for a tapped transformer which overcomes the above-given disadvantages, that is which can be made of a minimal number of parts and that can easily accommodate bridge contacts that are of fairly sloppy tolerances.

SUMMARY OF THE INVENTION

The instant invention is a bridge-contact assembly used in combination with an inner contact ring and a contact terminal of an array concentrically surrounding the ring. The bridge-contact assembly comprises a contact housing rotatable concentrically with and between the ring and array, a pair of bridge-contact jaws extending between the ring and the array and having inner ends gripping the ring and outer ends gripping a one of the terminals of the array, and a contact holder spacedly surrounding the pair of jaws and spacedly surrounded by the contact housing. At least one jaw spring supports the jaws in the holder and urges the jaws together and at least one holder spring supports the holder in the contact housing.

Thus with the system of this invention different jaws are used for different transformers, but the same housing and springs can be used. The holder is an annular sheet-metal structure that has no electrical function so it can be made fairly cheaply. The contact housing according to this invention comprises an annular inner element, an outer element spaced radially outside the inner element, and spacer bolts fixedly interconnecting the inner and outer elements. The holder is radially between the inner and outer elements. Such a two-part contact housing can be made of two separate cast metal parts so that it can operate as a current-carrying electrode shielding the contact holder, if necessary.

Furthermore the completely floating construction of the bridge-contact assembly according to this invention ensures that the contacts will remain centered o the contacts they grip. The double spring mounting allows the device to compensate for considerable misalignment.

According to another feature of this invention the jaws extend generally horizontally with one of the jaws above the other and the springs are vertical. The springs beneath the jaws bear upward thereon with more force than the springs above the jaws. This compensates for the weight of the assembly and this effect can be achieved by using stiffer lower springs or shimming the lower springs to compress them more. In addition the holder springs are stiffer than the jaw springs.

The frame is annular and surrounds the jaws and there are a plurality of such holder springs and the housing is provided with seats for the holder springs. Furthermore a plurality of such jaw springs engage each jaw and each jaw is formed with seats in which the respective springs engage.

DESCRIPTION OF THE DRAWING

The above and other objects, features, and advantages will become more readily apparent from the following, reference being made to the accompanying drawing in which.

SPECIFIC DESCRIPTION

Figure 1:
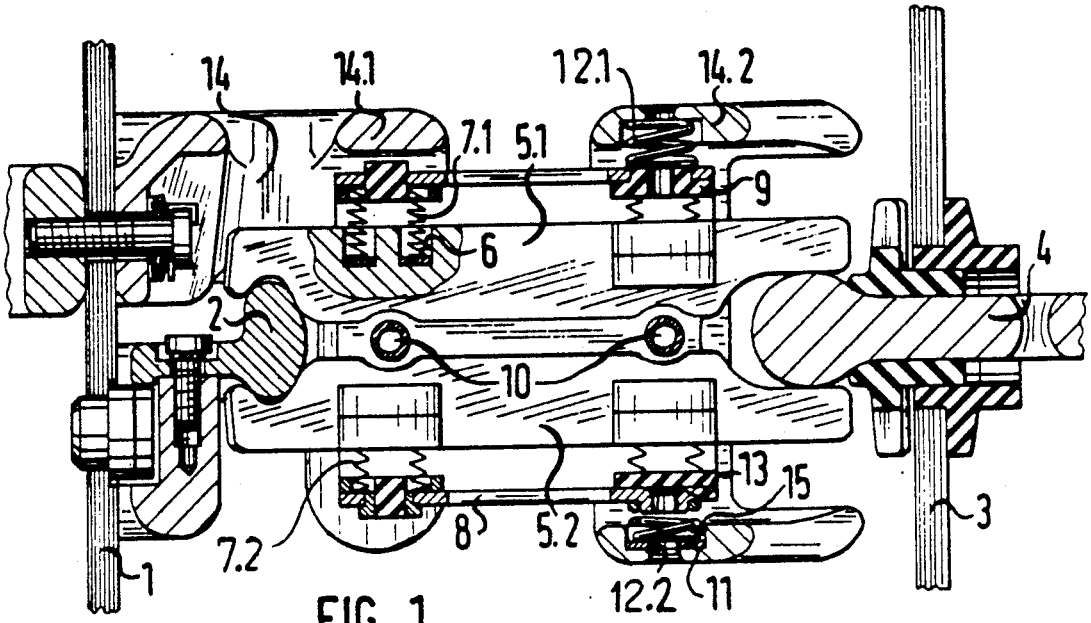
FIG. 1 is a vertical section through a bridge contact according to this invention.
Figure 2:
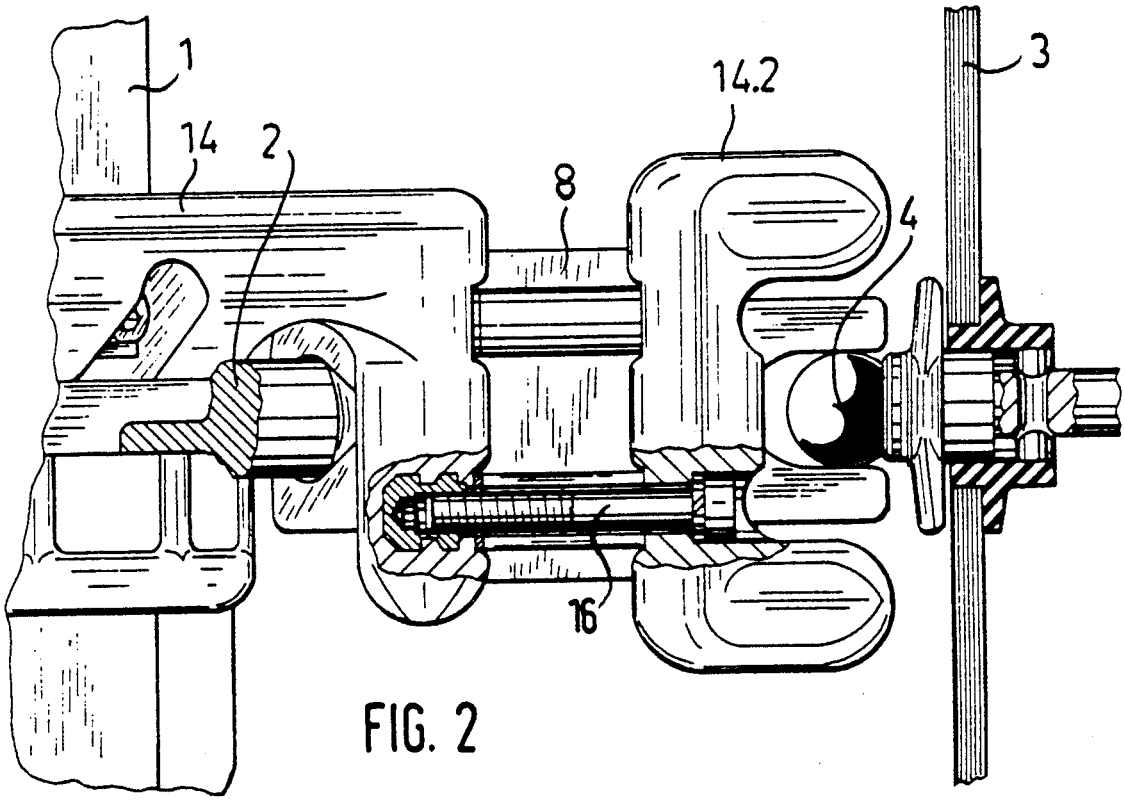
FIG. 2 is a side view partly in section through the contact of FIG. 1.

As seen in FIGS. 1 and 2 a tapped transformer has a selector column 1 provided with at least one contact ring 2 and lying inside a sleeve 3 carrying level with the ring 2 an array of contacts 4, of which only one is shown. Both the column 1 and sleeve 3 are coaxial and are made of a dielectric.

A bridge contact according to this invention comprises an upper jaw 5.1 and a substantially identical lower jaw 5.2 forming inner and outer mouths that respectively grip the ring 2 and the contact 4. Upper and lower sets of springs 7.1 and 7.2 are braced between the respective jaws 5.1 and 5.2 and an annular contact holder or frame 8 that is provided with special seats 9 for these springs 7.1 and 7.2. The jaws 5.1 and 5.2 are formed with pockets 6 in which the springs 7.1 and 7.2 are seated.

The contact frame 8 is made of sheet metal and surrounds the upper and lower jaws 5.1 and 5.2 and is provided with two guide pins 10 which pass between the jaws 5.1 and 5.2 to keep the various elements concentric. The same contact frame 8 can be used with jaws of different dimensions, so long as the spring pockets 6 are identically positioned. In addition the contact frame 8 is connected via upper and lower springs 12.1 and 12.2 to a bridge-contact housing 14 comprising an inner part 14.1 on the column 1 and an outer part 14.2. Radially extending bolts 16 interconnect the parts 14.1 and 14.2 so that they cannot move relative to each other.

The springs 12.1 and 12.2 are secured in the frame 8 on seats or retainers 13 and in recesses 15 in the housing 14. Several such upper springs 12.1 and lower springs 12.2 are provided although only one of each is shown. To compensate for gravity, the lower springs 12.2 are stiffer than the upper springs 12.1, and/or a shim 11 is provided under the lower springs 12.2. This keeps the bridge-contact assembly vertically centered. In addition the springs 12.1 and 12.2 are substantially stiffer than the springs 7.1 and 7.2 to compensate for the weight of the parts 5.1, 5.2, and 8 so that the jaws 5.1 and 5.2 effectively float centrally in the housing 14.

I claim:

1. In combination with a normally stationary inner contact ring and a contact terminal of a normally stationary array concentrically surrounding the ring, a bridge-contact assembly comprising:

a contact housing movable along a path concentric with and between the ring and array;

a pair of bridge-contact jaws extending between the ring and the array and having inner ends gripping the ring and outer ends gripping a one of the terminals of the array;

a contact holder spacedly surrounding the pair of jaws and spacedly surrounded by at least a portion of the contact housing;

respective jaw springs supporting the jaws in the holder and urging the jaws together; and a plurality of holder springs supporting the holder in the contact housing.

2. The bridge-contact assembly defined in claim 1 wherein the contact housing comprises:

an annular inner element;

an outer element spaced radially outside the inner element and constituting the portion surrounding the holder; and spacer bolts fixedly interconnecting the inner and outer elements.

3. The bridge-contact assembly defined in claim 1 wherein the jaws extend generally horizontally with one of the jaws above the other, the jaw and holder springs being vertical and including upper and lower jaw springs and upper and lower holder springs, the lower holder springs beneath the jaws bearing upward thereon with more force than the upper holder springs above the jaws.

4. The bridge-contact assembly defined in claim 1 wherein the holder springs are stiffer than the respective jaw springs.

5. The bridge-contact assembly defined in claim 1 wherein the holder is annular and surrounds the jaws.

6. The bridge-contact assembly defined in claim 1 wherein the housing is provided with seats for the holder springs.

7. The bridge-contact assembly defined in claim 1 wherein each jaw is formed with seats in which the respective jaw springs engage.

8. The bridge-contact assembly defined in claim 1 wherein the housing is wholly out of direct contact with the holder and the holder is wholly supported by the holder springs in the housing.

9. The bridge-contact assembly defined in claim 1 wherein the jaws are wholly out of direct contact with the holder and the jaws are wholly supported by the jaw springs in the holder.

* * * * *